US006725778B2

(12) United States Patent
Bitterich et al.

(10) Patent No.: US 6,725,778 B2
(45) Date of Patent: Apr. 27, 2004

(54) PRESSING DEVICE FOR A PRINTING PRESS OR VARNISHING MACHINE

(75) Inventors: Wolfgang Bitterich, Gemmingen (DE); Jürgen Rothaug, Nussloch (DE); Manfred Gross, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/394,933

(22) Filed: Mar. 21, 2003

(65) Prior Publication Data

US 2003/0177926 A1 Sep. 25, 2003

(30) Foreign Application Priority Data

Mar. 21, 2002 (DE) ..... 102 12 533

(51) Int. Cl.[7] ..... B41F 13/42; B41F 30/04
(52) U.S. Cl. ..... 101/477; 101/415.1
(58) Field of Search ..... 101/477, 415.1, 101/378, 216, 217

(56) References Cited

U.S. PATENT DOCUMENTS 5,309,835 A * 5/1994 Hartung et al. ..... 101/415.1
5,511,478 A * 4/1996 Lindner et al. ..... 101/477
5,617,792 A * 4/1997 Rau et al. ..... 101/477
5,715,752 A * 2/1998 Rother et al. ..... 101/415.1

FOREIGN PATENT DOCUMENTS

DE 2 156 044 7/1972
DE 100 18 923 A1 12/2000

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A pressing device for a printing press or varnishing machine includes a pressing roller for rolling a cylinder packing or dressing onto a circumferential surface of a cylinder, and a finger protection device including a first flap and a second flap connected to the first flap via a swivel joint. The first flap is formed as a pressing element for pressing the cylinder packing on the cylinder. The first flap, in a protective position thereof, covers an inlet wedge or pocket jointly formed by the pressing roller and the cylinder. A printing press or varnishing machine having the pressing device is also provided.

15 Claims, 3 Drawing Sheets

PRESSING DEVICE FOR A PRINTING PRESS OR VARNISHING MACHINE

BACKGROUND OF THE INVENTION

Field of the Invention

The invention relates to a pressing device for a printing press or varnishing machine, which has a pressing roller for rolling a cylinder packing or dressing onto a circumferential surface of a cylinder, and has a finger protection device including a first flap and a second flap connected to the first flap via a swivel joint. The first flap, in a protective position, covers an inlet wedge or pocket jointly formed by the pressing roller and the cylinder.

German Published, Non-prosecuted Patent Application DE 100 18 923 A1 describes such a pressing device. However, in that device, it remains for the operator to bend the cylinder packing manually and without technical assistance into a cylinder gap formed in the cylinder and, in that regard, to force a trailing edge of the cylinder packing towards a clamping device disposed in the cylinder gap.

A pressing device described in German Published, Non-prosecuted Patent Application 2 156 044 has a similarly inconvenient type of operation.

SUMMARY OF THE INVENTION

It is accordingly an object of the invention to provide a pressing device for a printing press or varnishing machine, which overcomes the hereinafore-mentioned disadvantages of the heretofore-known devices of this general type and which permits more comfortable tight clamping of the trailing edge of the cylinder packing.

With the foregoing and other objects in view, there is provided, in accordance with the invention, a pressing device for a printing press or varnishing machine. The pressing device comprises a pressing roller for rolling a cylinder packing or dressing onto a circumferential surface of a cylinder, and a finger protection device including a first flap and a second flap connected to the first flap via a swivel joint. The first flap is formed as a pressing element for pressing the cylinder packing on the cylinder, and the first flap, in a protective position thereof, covers an inlet wedge or pocket jointly formed by the pressing roller and the cylinder.

In accordance with another feature of the invention, the first flap is mounted so as to be displaceable into a pressing position thereof wherein the first flap bears on the cylinder packing.

In accordance with a further feature of the invention, the first flap, in the pressing position thereof, is received in a cylinder gap formed in the cylinder.

In accordance with an added feature of the invention, the first flap, in the pressing position thereof, holds the cylinder packing on a clamping pad of a clamping device of the cylinder.

In accordance with an additional feature of the invention, the first flap, in the pressing position thereof, holds the cylinder packing bent into a cylinder gap formed in the cylinder.

In accordance with yet another feature of the invention, in a protective position of the first flap, a rolling element or a sliding element is disposed on the first flap. A spring holds the element in contact with a guide track.

In accordance with yet a further feature of the invention, the first flap is mounted so as to be swivelable about the swivel joint from the protective position into a switching position wherein the element is lifted off the guide track by overcoming the force of the spring.

In accordance with yet an added feature of the invention, in the protective position, the element is seated in a latching recess formed in the guide track.

In accordance with yet an additional feature of the invention, the guide track is a curved cam track of a cam, and the element is a cam follower element.

With the objects of the invention in view, there is also provided a printing press or a varnishing machine, comprising a pressing device. The pressing device includes a pressing roller for rolling a cylinder packing or dressing onto a circumferential surface of a cylinder, and a finger protection device including a first flap and a second flap connected to the first flap via a swivel joint. The first flap is formed as a pressing element for pressing the cylinder packing on the cylinder. The first flap, in a protective position thereof, covers an inlet wedge or pocket jointly formed by the pressing roller and the cylinder.

In the pressing device according to the invention, the first flap is multifunctional. The first flap serves, for one, for protecting the operator against injury and, for another, for making the work of the operator easier when a trailing edge of the cylinder packing is being clamped. A particularly compact construction of the pressing device is provided due to the multifunctionality. Only relatively little installation space is required within the printing press or varnishing machine for the integration of the pressing device. This compactness would not be provided in the case of a pressing device constructed differently from the pressing device according to the invention, which includes a pressing roller, a finger protection device and, in addition, a pressing element. In the case of the pressing device according to the invention, it is also advantageous that the pressing roller is available for rolling the cylinder packing on the cylinder, and the pressing element formed by the first flap is available for bending the cylinder packing into a cylinder gap of the cylinder and for pressing a trailing edge of the cylinder packing towards a clamping device disposed in the cylinder gap. Each of the two parts used to press the cylinder packing on the cylinder, i.e., the pressing roller and the pressing element, is optimally constructed with respect to the specific task thereof. The pressing roller is specifically constructed for rolling the cylinder packing onto the circumferential surface of the cylinder. The pressing element formed by the finger protection device is specifically constructed for bending the cylinder packing near the trailing edge thereof. In a pressing device wherein a pressing roller and a pressing element, differing from those of the invention, were not two different parts but one and the same part, construction compromises would have to be made and, therefore, functional deficiencies with respect to each of the individual functions, the rolling and the bending, would have to be accepted.

The pressing roller of the pressing device according to the invention is a pressing roller that is different from a rubber or blanket cylinder, i.e., it is not a rubber or blanket cylinder.

The cylinder packing may be a printing plate, for example, an offset printing plate, or a flexographic printing plate used for varnishing or a rubber blanket used, for example, for varnishing. Accordingly, the cylinder is a plate or blanket cylinder.

Advantageous developments of the pressing device according to the invention are noted hereinbelow.

One development is distinguished by the fact that the first flap is mounted so as to be adjustable into a pressing position, wherein the first flap bears on the cylinder packing.

The content of a further development is that in the pressing position the first flap is received in or dips into a cylinder gap of the cylinder.

According to a further development, in the pressing position, the cylinder packing is held by the first flap on a clamping pad of a clamping device of the cylinder.

The fact that, in the pressing position, the cylinder packing is held bent by the first flap in the cylinder gap formed in the cylinder distinguishes a further development.

The content of a further development is that, in the protective position, a rolling or sliding element disposed on the first flap is held by a spring in contact with a guide track.

A further development is that the first flap is mounted so that it is swivelable about the joint from the protective position into a switching position, wherein the rolling or sliding element is raised off the guide track when overcoming the force of the spring.

According to one development, provision is made for the rolling or sliding element to be seated in a latching recess in the guide track when in the protective position. The guide track may be a curved cam track of a cam, and the rolling or sliding element may be a cam follower element.

Other features which are considered as characteristic for the invention are set forth in the appended claims.

Although the invention is illustrated and described herein as embodied in a pressing device for a printing press or varnishing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
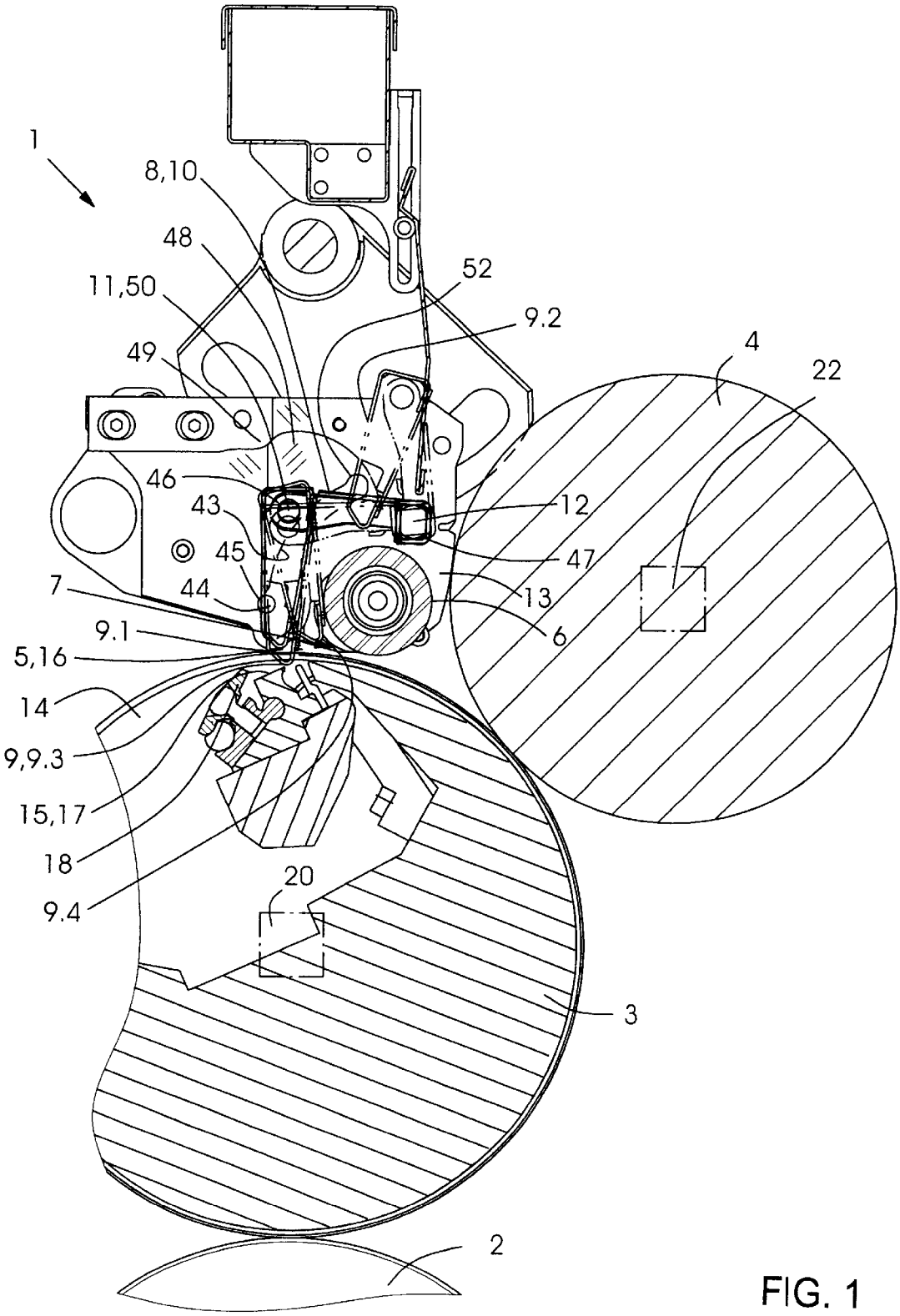
FIG. 1 is a fragmentary, diagrammatic cross-sectional view of a printing press or varnishing machine incorporating the pressing device according to the invention.
Figure 2:
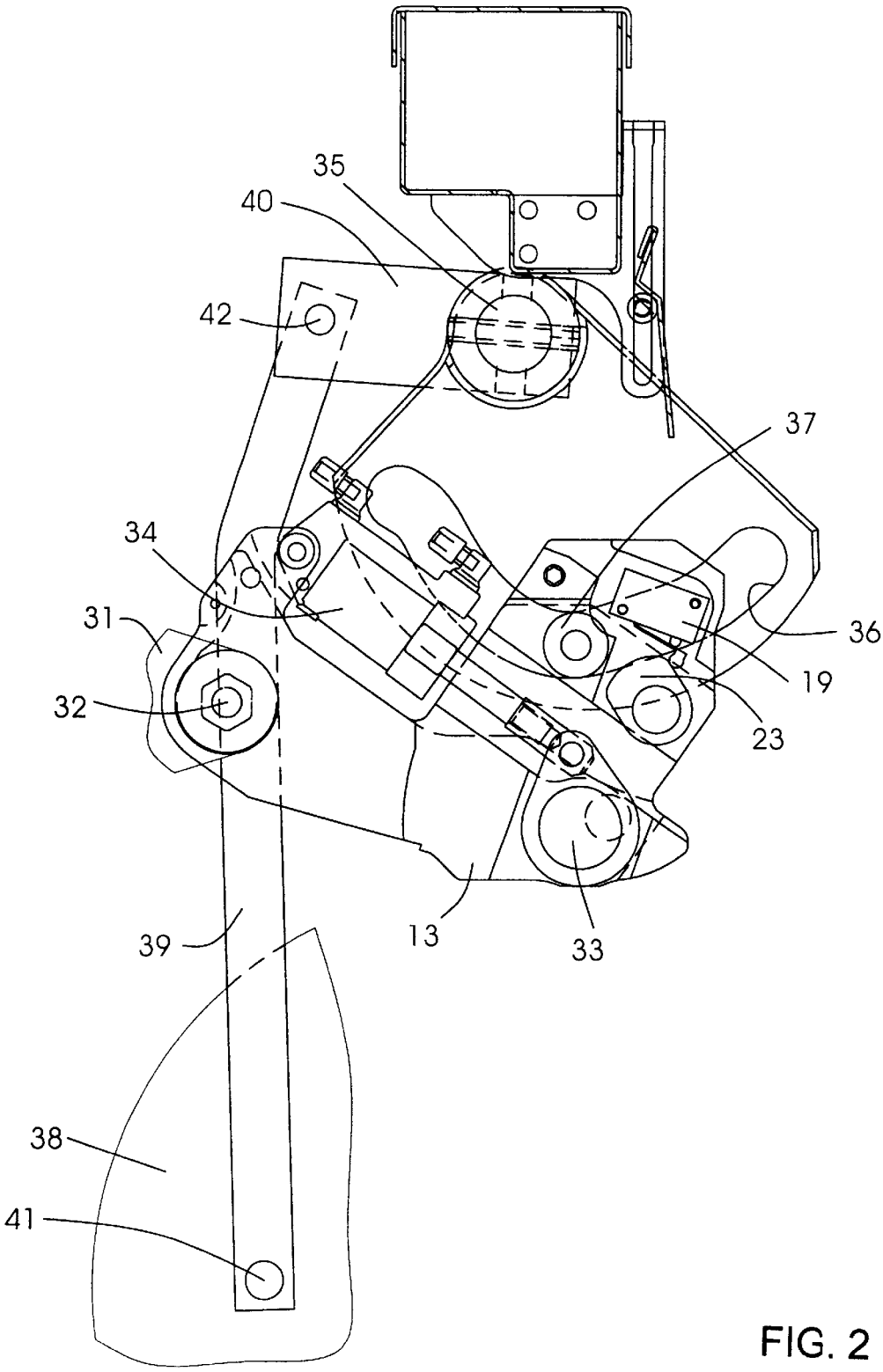
FIG. 2 is an enlarged, fragmentary view of FIG. 1, showing the pressing device in greater detail.
Figure 3:
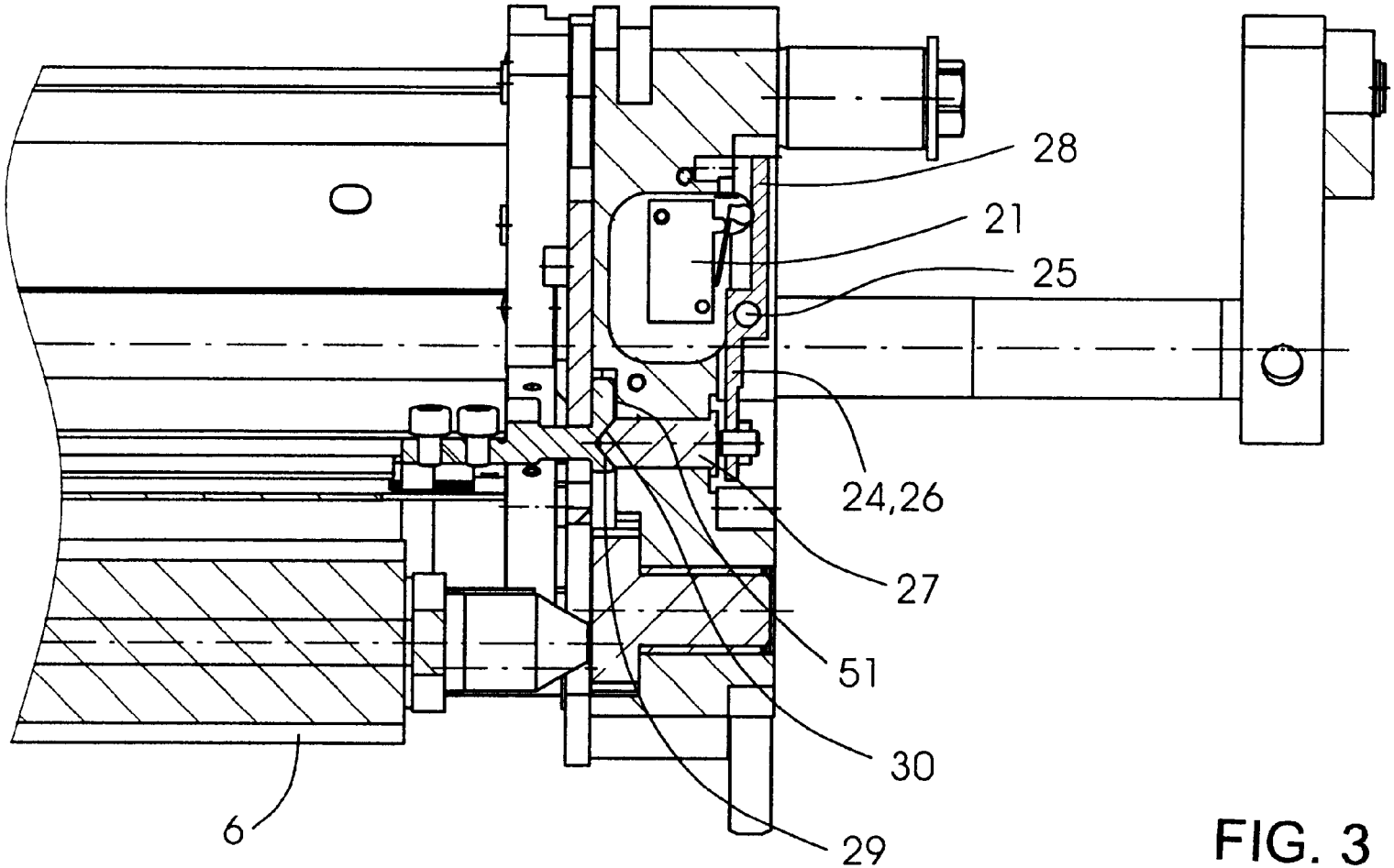
FIG. 3 is a fragmentary, longitudinal-sectional view of FIG. 2, showing further details of the pressing device.

Referring now to FIGS. 1 to 3 of the drawings in detail as a whole, there is seen a part of a printing press or varnishing machine 1 for processing sheet printing material, which includes an impression cylinder 2, another cylinder 3 and an applicator roller 4 bearing against a non-illustrated chambered doctor blade or a likewise non-illustrated dip roller. If the applicator roller 4 bears against the chambered doctor blade, the applicator roller 4 is a screen or anilox roller. A cylinder packing 5 covering the cylinder 3 is a printing plate, especially a flexographic printing plate for varnishing.

A pressing roller 6 has a much smaller outer diameter than that of the cylinder 3 and, together with the latter, forms an inlet wedge or pocket 7 therebetween.

A finger protection device 8 which is disposed beside the pressing roller 6 includes two flaps, namely a first protective flap 9 and a second protective flap 10, enclosing the pressing roller 6 from two sides. The pressing roller 6 has a soft, resilient roller packing or covering and is approximately as wide as the cylinder packing 5. The protective flaps 9 and 10 are approximately as long as and even somewhat longer than the pressing roller 6. The protective flaps 9 and 10 are connected to one another via an articulation or joint, more particularly, a first swivel joint 11. The second protective flap 10 is fixed to a support 13 via a second swivel joint 12.

The cylinder 3 is formed with a cylinder gap 14 wherein there is disposed a clamping device 15 for a trailing edge 16 of the cylinder packing 5. The clamping device 15 includes a clamping pad 17 and a clamping jaw 18.

The finger protection device 8 includes a first electric switch 19 which is linked, in terms of control technology, only to a first electric motor 20 for rotatingly driving the cylinder 3, and a second electric switch 21 which is linked, in terms of control technology, both to the first electric motor 20 and to a second electric motor 22 rotatingly driving the applicator roller 4. The switches 19 and 21 are fixed to the support 13 and constructed as momentary-contact switches or keys (push buttons). If such a momentary-contact switch is pressed, one switching position thereof, for example current flow, is set and, if the corresponding momentary-contact switch is not pressed, then the other switching position thereof, for example current blocked, is set. The switches 19 and 21 reset automatically and, for this purpose, are equipped with restoring springs, for example, which change or switch the switches 19 and 21 over the instant an external compressive force acting upon the switches 19 and 21 is reduced.

A cam 23 for actuating the first switch 19 is disposed so as to be rotatable about an axis of rotation coaxial with the second swivel joint, and is connected to the second protective flap 10 so as to be fixed against rotation relative thereto, so that the cam 23 is entrained by and moved together with the second protective flap 10 when the second protective flap 10 is swiveled about the second swivel joint 12.

In a departure from the exemplary embodiment shown, the cam 23 and the second protective flap 10 could also be one and the same part.

A rocker 24, illustrated in FIG. 3 and serving for actuating the second switch 21, is mounted so as to be swivelable about a third swivel joint 25. The swivel joints 11 and 12 are aligned axially parallel with an axis of rotation of the pressing roller 6, and the third swivel joint 25 is aligned perpendicularly to the axis of rotation of the pressing roller 6. The rocker 24 has a first arm 26 engaged by a slide 27, and a second arm 28 for actuating the second switch 21. The slide 27 is coupled, in terms of gear-transmission technology, with the first protective flap 9 via an inner cone 29 and an outer cone 30 which is inserted or plugged into the inner cone 29. The inner cone 29 is disposed on the first protective flap 9, and the outer cone 30 is provided on the slide 27. The cones 29 and 30 together form a wedge transmission which, during movements of the first protective flap 9 about the rotary joints 11 and 12, causes displacements of the slide 27 in a thrust direction axially parallel to the swivel joints 11 and 12.

The support 13 is fixed to a frame 31 via a fourth swivel joint 32. The pressing roller 6 is fixed to the support 13 via an eccentric bearing 33 so as to be adjustable relative to the carrier 13.

A pneumatic operating cylinder 34, which functions as an actuating drive for setting the pressing roller 6 on and off the cylinder packing 5, is attached by one end thereof to the support 13 and by the other end thereof to the eccentric bearing 33. The extension and retraction of a piston of the operating cylinder 34 effects rotations of the eccentric bearing 33 and consequently the adjustment of the pressing roller 6 relative to the support 13.

In order to adjust the support 13 relative to the frame 31, there is assigned to the support 13 a first cam mechanism which includes a first cam 36 in the form of a coulisse or sliding block crank mounted so that it is swivellable about a fifth swivel joint 35, and a first cam follower element 37 in the form of a cam roller disposed on the support 13. The first cam follower element 37 engages in a curved cam groove formed in the first cam 36.

A (four-link) coupler mechanism includes, in addition to the fifth swivel joint 35, a drive swinging arm 38, a coupler 39, a driven swinging arm 40 and, to connect the coupler 39 to the swinging arms 38 and 40, a sixth swivel joint 41 and a seventh swivel joint 42. The drive swinging arm 38 is formed by a cylinder adjusting bearing serving for throwing the cylinder 3 on and off the impression cylinder 2 and, therefore, for throwing the impression on and off. The cylinder adjustment bearing can be a so-called three-point bearing, which includes a bearing ring wherein an axle journal of the cylinder 3 is rotatably mounted and has a circumferential contour which is not circular but corresponds to a curve and is supported at three points. The cylinder adjusting bearing can, however, also be a so-called three-ring bearing having three bearing rings plugged or inserted into one another, one of the bearing rings being an eccentric bushing. The driven swinging arm 40 is connected to the first cam 36 so as to be fixed against rotation relative thereto, so that a swivelling movement of the drive swinging arm 38 necessarily results in a swiveling movement of the first cam 36.

In a departure from the illustrated exemplary embodiment, the first cam 36 and the driven swinging arm 40 could also be one and the same part.

The last-mentioned swivelling movement of the first cam 36, in turn, effects an adjustment of the first cam follower element 37 and, therefore, also of the support 13 relative to the frame 31. A spaced distance between the finger protection device, more particularly, the first protective flap 9, and the cylinder 3, which should be kept as small as possible for safety reasons, is therefore kept continuously constant via the coupling mechanism and the first cam mechanism as the cylinder 3 is thrown on and off impression or printing, in that the finger protection device is automatically being entrained by the cylinder 3, so that a high level of safety is ensured in any operating situation.

A second cam mechanism includes a curved, second cam 43, with which the support 13 is provided, and a pin-shaped, second cam follower element 44, which is disposed offset with respect to the first swivel joint 11 on the first protective flap 9. The second cam 43 is provided, in the cam or guide track, respectively, thereof, with a prismatic or trough-shaped latching recess 45, wherein the second cam follower element 44 latches when the first protective flap 9 is in a protective position 9.1.

A first spring 46 biases the first protective flap 9 with the second protective flap 10 and holds the second cam follower element 44 against the second cam 43. The first spring 46 is a leg spring or torsion spring (spring clip), which is pushed onto a hinge pin of the first swivel joint 11 and is supported by one leg thereof on the first protective flap 9 and by the other leg thereof on the second protective flap 10. The first spring 46 disposed between the protective flaps 9 and 10 attempts to force the protective flaps 9 and 10 into an extended position.

A second spring 47 biases the second protective flap 10 with the support 13 and attempts to swivel the second protective flap 10 about the second swivel joint 12 into a position wherein the first protective flap 9 is in a maintenance position 9.2, wherein the finger protection device is drawn completely back from the pressing roller 6, and access to the pressing roller 6, for example for the purpose of cleaning it, is possible without difficulty. The second spring 47 is a leg spring which is pushed onto the hinge pin of the second swivel joint 12 and is supported by one leg thereof on the second protective flap 10 and by the other leg thereof on the support 13.

Taking into account the effective torque lever lengths, namely the distance between the second cam follower element 44 and the first swivel joint 11, and the distance between the first swivel joint 11 and the second swivel joint 12, as well as the inclination of the flank or side of the latching recess 45, the springs 46 and 47 are matched with or adjusted to one another with respect to the spring characteristics and spring forces, respectively, thereof, so that the first spring 47 maintains the second cam follower element 44 in the latching recess 45 by overcoming the spring force from the second spring 47, when the protective position 9.2 is set. The second spring 47 attempts to pull the second cam follower element 44 out of the latching recess 45.

A third cam mechanism serves for displacing the first protective flap 9 out of the protective position 9.1 into a pressing position 9.3, wherein the first protective flap 9 presses against the cylinder packing 5 close to the trailing edge 16 thereof, penetrates into the cylinder gap 14 somewhat and maintains the trailing edge 16 in contact with the clamping pad 17. Due to the displacement of the first protective flap 9 into the pressing position 9.3, the cylinder packing 5 is "canted" or "bent over" at a point of flexure of the cylinder packing 5 located close to the trailing edge 16 and in the vicinity of an edge defining the cylinder gap 14, and is bent over at a shallow angle to a cylinder tangent located at the point of flexure into the cylinder gap 14 and towards the clamping device 15. The third cam mechanism includes a third cam 48 which is connected to the first protective flap 9 so as to be fixed against rotation relative thereto, is supported on a cam stop 49 belonging to the support 13 and is seated on a shaft formed by the hinge pins of the second swivel joint 11.

In a departure from the illustrated exemplary embodiment, the third cam 48 and the first protective flap 11 could also be one and the same part.

The pressing device according to the invention functions as follows:

In a first step, a leading edge of the cylinder packing 5 is clamped firmly in a front clamping device of the cylinder 3.

In a second step, the pressing roller 6 is set against the cylinder packing 5 resting on the circumferential surface of the cylinder 3, by activating the operating cylinder 34.

In a third step, the cylinder 3 is rotated slowly by the first electric motor 20, so that the pressing roller 6 rolls on the cylinder packing 5 towards the rear clamping device 15. When the cylinder 3 is located in the rotational position shown in FIG. 1, the rotation of the cylinder 3 is stopped again. At this time, the cylinder packing 5 wraps around the cylinder 3 from a leading edge of the cylinder gap 14 to as far as the rear or trailing edge of the cylinder gap 14. In addition, the gap trailing edge 16, which projects approximately tangentially over the trailing gap edge, is already located above the clamping pad 17.

In a fourth step, the first protective flap 9 is displaced from the protective position 9.1 into the pressing position 9.3, by rotating the third cam 48 with the aid of a socket wrench, which is inserted into a transverse hole formed in the hinge pin 50 of the first swivel joint 11, which functions as a drive shaft for the third cam 48. During this displacement of the first protective flap 9 into the pressing position 9.3, the protective flaps 9 and 10 swivel about the second swivel joint 12, and cause the cam contour of the third cam 48 to rise so that the finger protection device is forced away from the cam stop 49.

The first protective flap 9 is kept in the pressing position 9.3 by a self-locking action of the second cam mechanism, i.e., by a friction lock or contact acting between the second cam 43 and the second cam follower element 44. The operator thus has both hands free, in a fifth step, for displacing the clamping jaw 18 towards the clamping pad 17 and the trailing edge 16 resting on the latter and, in this manner, for clamping the trailing edge 16 between the clamping pad 17 and the clamping jaw 18.

In a sixth step, the pressing roller 6 is lifted off the cylinder packing 5 again, and the first protective flap 9 is displaced back from the pressing position 9.3 into the protective position 9.1.

In a seventh step, the rear clamping device 15 with the trailing edge 16 firmly clamped therein is displaced in a tensioning direction corresponding approximately to the circumferential direction of the cylinder 3, so that the cylinder packing 5 is pulled taut.

Thereafter, the cylinder 3 is set into rotation again, and the cylinder packing 5 is inked by the applicator roller 4, so that the cylinder packing 5 is then ready for printing.

The finger protection device functions as follows:

If the operator strikes the first protective flap 9 with his or her hand, the flap 9 is then swiveled out of the protective position 9.1 and about the first swivel joint 11 into a switching position 9.4. In this regard, the second cam follower element 44 lifts off the second cam 43, and the second switch 21 is switched over by a compressive force exerted on the second switch 21 by the rocker 24.

Likewise, the second switch 21 is actuated by such a compressive force when the operator displaces the first protective flap 9 from the protective position 9.1 into the pressing position 9.3 or the maintenance position 9.2, the second cam follower element 44 being moved out of the latching recess 45 and along the second cam 43 in both of the last-mentioned cases of the displacement.

The second cam 43 is provided with such a contour and, particularly, the configuration of the latching recess 45 between end points of the cam track and guide track, respectively, of the second cam 43 and within this cam track and guide track, respectively, is selected so that the second cam follower element 44 is movable out of the latching recess 45 in three directions corresponding to the settings of the positions 9.2 to 9.4. The second cam follower element 44 is movable in the two directions extending towards the mutually opposing end points of the second cam 43 while maintaining the contact with the second cam 43 and, when lifted off the guide track and cam track, respectively, of the second cam 43, is movable in the lifting direction approximately perpendicular to this guide track and cam track, respectively.

Regardless of which of the three positions 9.2 to 9.4 into which the operator attempts to displace the protective flap 9, the actuation of the second switch 21 triggered thereby results in the switching-off by the second switch 21 of only the first electric motor 20 but not the second electric motor 22, so that, although the rotation of the cylinder 3 is immediately stopped, the applicator roller 4 continues to rotate as before, so that the applicator roller 4, for example, continues to roll on the non-illustrated dip roller and thus, even when the cylinder 3 is at a standstill, the printing ink or the varnish is prevented from drying out on the applicator roller 5.

If the applicator roller 5 is set on or engaged with the cylinder 3 at the instant at which the latter is stopped by an emergency stop, the actuation of the second switch 21 has the effect of automatically disengaging or setting the applicator roller 5 off the cylinder 3.

The slide 27 is supported on a supporting face 51, into which the inner cone 29 is introduced, via a tip on the outer cone 30 when the first protective flap 9 is in the switching position 9.4 or the pressing position 9.3, and the outer cone 30 is no longer inside the inner cone 29.

If the first protective flap 9 is in the maintenance position 9.2, the support for the slide 27 is then no longer provided by the supporting face 51, and the action of the compressive force exerted on the second switch 21 by the rocker 24 is cancelled, so that the second switch 21 is switched back into the nonpressed switching position again from the pressed switching position by a spring belonging to the second switch 21. Although the second switch 21 has been switched back, in this situation the first electric motor 20 cannot start up, and the cylinder 3 cannot rotate, because when the maintenance position 9.2 is set, the cam 23 holds the first switch 19 pressed, so that both electric motors 20 and 22 are deactivated by the first switch 19. When the maintenance position 9.2 is set, the applicator roller 4 must namely also no longer rotate either.

At least one of the two switches 19 and 21 is therefore always pressed and switched into a switching position deactivating the first electric motor 20, as long as the first protective flap 9 is out of the protective position 9.1 thereof.

In order to set the maintenance position 9.2, the third cam 48 must be rotated into a rotary position wherein the third cam 48 no longer bears, with the cam contour thereof, on the cam stop 49 and, in that rotary position, the second cam follower element 44 is no longer in the latching recess 45, so that the second spring 47 can swivel the protective flaps 9 and 10 about the second swivel joint 12 and, in this way, can displace the first protective flap 9 into the maintenance position 9.2. A further latching recess 52 in the second cam 43 accommodates the second cam follower element 44 when the maintenance position 9.2 is set.

We claim:

1. In a printing press or varnishing machine having a cylinder with a circumferential surface, a pressing device, comprising:

a pressing roller for rolling a cylinder packing or dressing onto the circumferential surface of the cylinder, said pressing roller and the cylinder jointly forming an inlet wedge or pocket; and a finger protection device including a first flap, a second flap and a swivel joint connected between said first and second flaps, said first flap being a pressing element for pressing the cylinder packing or dressing on the cylinder in a pressing position, and said first flap covering said inlet wedge or pocket in a protective position of said first flap.

2. The pressing device according to claim 1, wherein said first flap is mounted for displacement into the pressing position, and said first flap bears on the cylinder packing or dressing in said pressing position.

3. The pressing device according to claim 2, wherein said first flap is received in a cylinder gap formed in the cylinder, in said pressing position of said first flap.

4. The pressing device according to claim 2, wherein the cylinder has a clamping device with a clamping pad, and said first flap holds the cylinder packing or dressing on the clamping pad, in said pressing position of said first flap.

5. The pressing device according to claim 2, wherein said first flap holds the cylinder packing or dressing bent into a cylinder gap formed in the cylinder, in said pressing position of said first flap.

6. The pressing device according to claim 1, which further comprises a guide track, a rolling element disposed on said first flap, and a spring for holding said rolling element in contact with said guide track in the protective position of said first flap.

7. The pressing device according to claim 1, which further comprises a guide track, a sliding element disposed on said first flap, and a spring for holding said sliding element in contact with said guide track in the protective position of said first flap.

8. The pressing device according to claim 6, wherein said first flap is mounted to swivel about said swivel joint from said protective position into a switching position, and said rolling element is lifted off said guide track by overcoming a force of said spring in said switching position.

9. The pressing device according to claim 7, wherein said first flap is mounted to swivel about said swivel joint from said protective position into a switching position, and said sliding element is lifted off said guide track by overcoming a force of said spring in said switching position.

10. The pressing device according to claim 6, wherein said rolling element is seated in a latching recess formed in said guide track in said protective position.

11. The pressing device according to claim 7, wherein said sliding element is seated in a latching recess formed in said guide track in said protective position.

12. The pressing device according to claim 6, wherein said guide track is a curved cam track of a cam, and said rolling element is a cam follower element.

13. The pressing device according to claim 7, wherein said guide track is a curved cam track of a cam, and said sliding element is a cam follower element.

14. A printing press, comprising:

a cylinder with a circumferential surface; and a pressing device including:

a pressing roller for rolling a cylinder packing or dressing onto said circumferential surface of said cylinder, said pressing roller and said cylinder jointly forming an inlet wedge or pocket; and a finger protection device including a first flap, a second flap and a swivel joint connected between said first and second flaps, said first flap being a pressing element for pressing the cylinder packing or dressing on said cylinder in a pressing position, and said first flap covering said inlet wedge or pocket in a protective position of said first flap.

15. A varnishing machine, comprising:

a cylinder with a circumferential surface; and a pressing device including:

a pressing roller for rolling a cylinder packing or dressing onto said circumferential surface of said cylinder, said pressing roller and said cylinder jointly forming an inlet wedge or pocket; and a finger protection device including a first flap, a second flap and a swivel joint connected between said first and second flaps, said first flap being a pressing element for pressing the cylinder packing or dressing on said cylinder in a pressing position, and said first flap covering said inlet wedge or pocket in a protective position of said first flap.

* * * * *